US008820585B1

(12) United States Patent
Banks et al.

(10) Patent No.: US 8,820,585 B1
(45) Date of Patent: Sep. 2, 2014

(54) FOAM DISPENSER WITH A POROUS FOAMING ELEMENT

(71) Applicant: Pibed Limited, Denby (GB)

(72) Inventors: Stewart Banks, Carvoiro (PT); Christopher James Lang, Nottingham (GB); Dean Philip Limbert, Derby (GB)

(73) Assignee: Pibed Limited, Denby Ripley (GB)

( * ) Notice: Subject to any disclaimer, the term of this patent is extended or adjusted under 35 U.S.C. 154(b) by 0 days.

(21) Appl. No.: 13/842,281

(22) Filed: Mar. 15, 2013

(51) Int. Cl.
*B67D 7/76* (2010.01)

(52) U.S. Cl.
USPC ..... 222/190; 222/321.1; 222/181.1; 222/1; 222/145.5; 222/145.6

(58) Field of Classification Search
USPC ..... 222/190, 145.5, 189.06, 189.11, 181.1
See application file for complete search history.

(56) References Cited

U.S. PATENT DOCUMENTS

| | | | | |
|---|---|---|---|---|
| 2,593,178 | A | 4/1952 | Paul | |
| 3,208,958 | A | 9/1965 | Jennings | |
| 3,937,364 | A | 2/1976 | Wright | |
| 4,018,364 | A * | 4/1977 | Wright | 222/190 |
| 4,022,351 | A | 5/1977 | Wright | |
| 4,068,625 | A | 1/1978 | Brown | |
| 4,184,615 | A | 1/1980 | Wright | |
| 5,238,155 | A | 8/1993 | Blake, III | |
| 5,397,001 | A | 3/1995 | Yoon et al. | |
| 5,443,569 | A * | 8/1995 | Uehira et al. | 222/190 |
| 5,445,288 | A | 8/1995 | Banks | |
| 5,451,104 | A | 9/1995 | Kleen et al. | |
| 5,649,334 | A | 7/1997 | Henriquez et al. | |
| 5,662,811 | A | 9/1997 | Grisham et al. | |
| 6,082,586 | A | 7/2000 | Banks | |
| 6,271,275 | B1 | 8/2001 | Malwitz | |
| 6,572,873 | B1 * | 6/2003 | Osman et al. | 424/423 |
| 7,770,874 | B2 | 8/2010 | Ophardt et al. | |
| 2005/0205600 | A1 | 9/2005 | Ophardt et al. | |
| 2006/0273114 | A1 * | 12/2006 | Ophardt | 222/321.1 |

(Continued)

FOREIGN PATENT DOCUMENTS

| | | |
|---|---|---|
| EP | 2545833 A2 | 1/2013 |
| EP | 2662008 A2 | 11/2013 |

(Continued)

OTHER PUBLICATIONS

U.S. Appl. No. 13/458,318. Shaw et al. filed Apr. 27, 2012.

(Continued)

*Primary Examiner* — Paul R Durand
*Assistant Examiner* — Jeremy W Carroll

(57) ABSTRACT

A foaming assembly includes a porous foaming element, a liquid chamber and an air chamber. The porous foaming element has an air inlet, a liquid inlet and an outlet. The porous foaming element has at least two zones of different pore sizes. The liquid chamber is in flow communication with the porous foaming element. The liquid chamber has a volume that is movable between an at rest postion to an activation position. The air chamber is in flow communication with the porous foaming element. The air chamber has a volume that is movable between an at rest position to an activation position. Liquid and air are forced into the porous foaming element under pressure wherein they mix to form foam which exits through the outlet. A dispenser may include a foaming assembly and a liquid container.

11 Claims, 12 Drawing Sheets

(56) References Cited

U.S. PATENT DOCUMENTS

| | | | | |
|---|---|---|---|---|
| 2007/0051748 | A1 | 3/2007 | Yates et al. | |
| 2008/0145401 | A1* | 6/2008 | Osman et al. | 424/423 |
| 2009/0200339 | A1* | 8/2009 | Quinlan et al. | 222/190 |
| 2009/0302072 | A1* | 12/2009 | Lang et al. | 222/571 |
| 2009/0308894 | A1* | 12/2009 | Ophardt | 222/190 |
| 2011/0006086 | A1 | 1/2011 | Yates | |
| 2011/0079614 | A1 | 4/2011 | Ganzeboom et al. | |
| 2011/0303762 | A1* | 12/2011 | Wegelin et al. | 239/102.2 |
| 2012/0067923 | A1 | 3/2012 | Matthews et al. | |
| 2012/0074171 | A1* | 3/2012 | Quinlan et al. | 222/190 |
| 2012/0104048 | A1* | 5/2012 | Tseng | 222/190 |
| 2012/0141309 | A1* | 6/2012 | Ciavarella | 417/490 |
| 2012/0160879 | A1* | 6/2012 | Ciavarella et al. | 222/409 |
| 2012/0205399 | A1* | 8/2012 | Lane et al. | 222/190 |
| 2012/0217267 | A1* | 8/2012 | Bunoz et al. | 222/145.5 |

FOREIGN PATENT DOCUMENTS

| | | | |
|---|---|---|---|
| WO | 8909095 | 11/1989 | |
| WO | WO 2005107699 A1 * | 11/2005 | A61K 7/50 |
| WO | 2009142886 | 11/2009 | |

OTHER PUBLICATIONS

International Search Report for corresponding PCT application No. PCT/CA2014/050191, mailed Jul. 10, 2014.

Written Opinion for corresponding PCT application No. PCT/CA2014/050191, mailed Jul. 10, 2014.

* cited by examiner

FOAM DISPENSER WITH A POROUS FOAMING ELEMENT

FIELD OF THE DISCLOSURE

This disclosure relates to foam dispensers and in particular foam dispensers having a porous foaming element wherein the air and liquid mix within the porous foaming element.

BACKGROUND

Foam dispensers are well known and widely used commercially. A wide variety of foam dispensers have been developed. In particular, a number of non-aerosol foam dispensers that use unpressurised liquid containers have been developed. The advantage of foam dispensers over soap dispensers is that for each wash less soap is used.

One way to reduce the costs for manufacturing is to reduce the number of components. Accordingly an embodiment that reduces the number of parts would be advantageous.

As well, an embodiment wherein the quality of foam is improved would also be advantageous.

SUMMARY

A foaming assembly includes a porous foaming element, a liquid chamber and an air chamber. The porous foaming element has an air inlet, a liquid inlet and an outlet. The porous foaming element has at least two zones of different pore sizes. The liquid chamber is in flow communication with the porous foaming element. The liquid chamber has a volume that is movable between an at rest position to an activation position. The air chamber is in flow communication with the porous foaming element. The air chamber has a volume that is movable between an at rest position to an activation position. Liquid and air are forced into the porous foaming element under pressure wherein they mix to form foam which exits through the outlet. A dispenser may include a foaming assembly and a liquid container.

The porous foaming element may have a smaller pore size zone and a larger pore size zone. The smaller pore size zone may be downstream of the larger pore size zone. Alternatively the smaller pore size zone may be upstream of the larger pore size zone. The porous foaming element may be generally bow tie shape in cross section.

The foaming assembly may include a foam cone, a piston and a bottle seal and wherein the piston and bottle seal define the liquid chamber, the foam cone, bottle seal and piston define the air chamber and movement inwardly of the foam cone into the bottle seal decreases the volume of the liquid chamber and the air chamber thereby forcing under pressure air and liquid into the porous foaming element.

The porous foaming element may be positioned in the foam cone between the foam cone and the piston. The porous foaming element may be made of compressible material and a smaller pore size zone is where the compressible material is more compressed than in a larger pore size zone. The shape of the porous foaming element may be defined by the geometry of the piston and the foam cone.

The foaming assembly may include a piston dome, a liquid and air bore and a main pump body and the piston dome, liquid and air bore and main body define a liquid chamber, the piston dome and liquid and air bore define the air chamber and movement inwardly of the piston dome into the main body decreases the volume of the liquid chamber and the air chamber thereby forcing under pressure air and liquid into the porous foaming element. The main pump body may include an exit nozzle and the porous foaming element is positioned in the exit nozzle between the liquid chamber and a venturi ring. The shape of the porous foaming element may be defined by the geometry of the exit nozzle and the venturi ring.

The foaming assembly may include a pump head, a bottle cap, an air piston, a piston and a main body and the main body and piston define the liquid chamber and the pump head, bottle cap, air piston, piston and main body define the air chamber movement inwardly of the pump head into the main body decreases the volume of the liquid chamber and the air chamber thereby forcing, under pressure, air and liquid into the porous foaming element. The shape of the porous foaming element may be defined by the geometry of the air piston and the pump head.

A foam dispenser includes a liquid container and a porous foaming element. The foam dispenser may further include a housing having an actuator wherein activating the actuator causes the air chamber and the liquid chamber to move between the at rest position to the activation position. The housing may further include at least one sensor and the actuator is activated responsive to the sensor sensing the presence of a user.

In another aspect there is provided a method of making foam including the steps of forcing air and liquid under pressure into a porous foaming element having at least two zones of different pore sizes wherein they mix to form foam which exits through the outlet.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
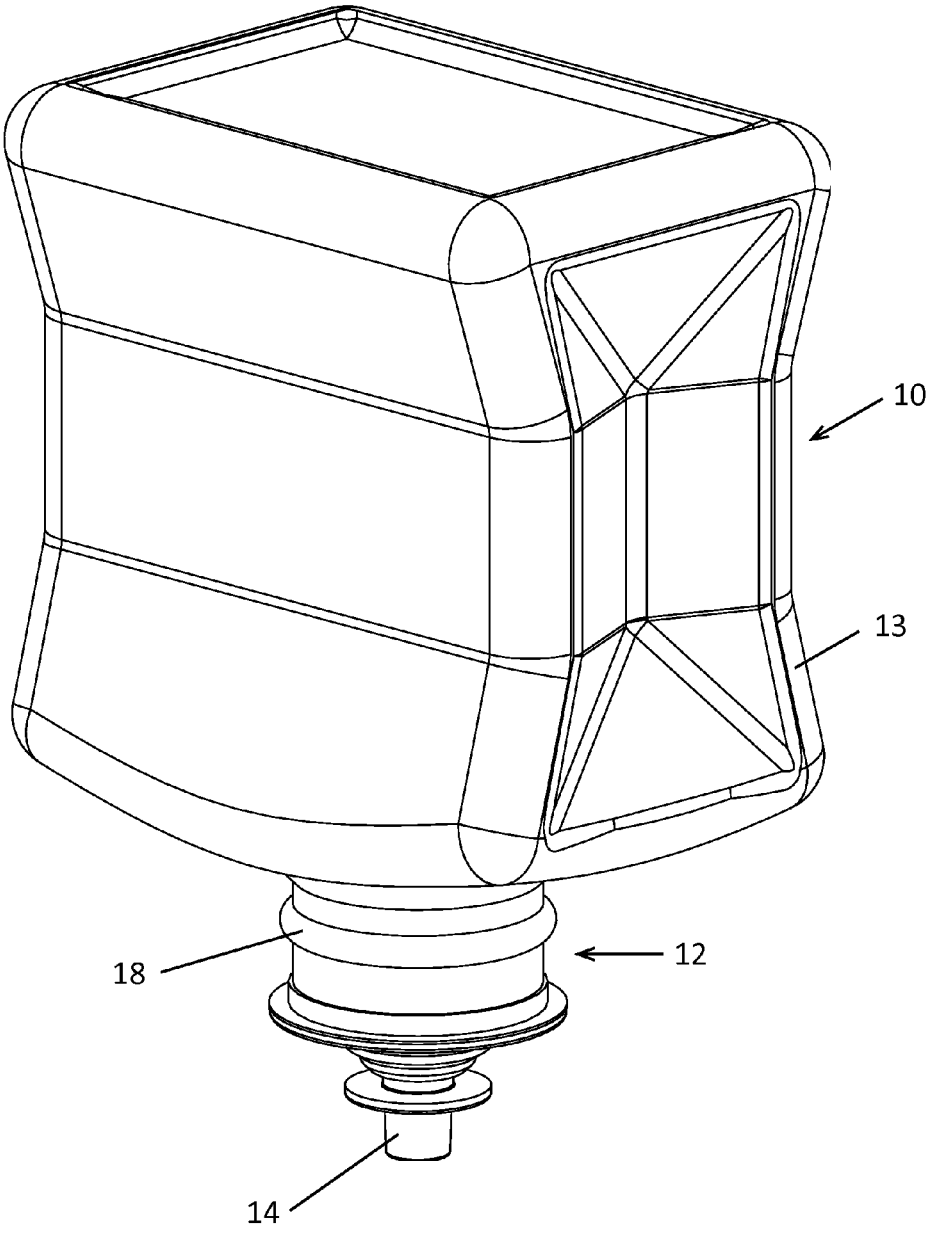
FIG. 1 is a perspective view of a foam dispenser including a foaming assembly with a porous foaming element.
Figure 2:
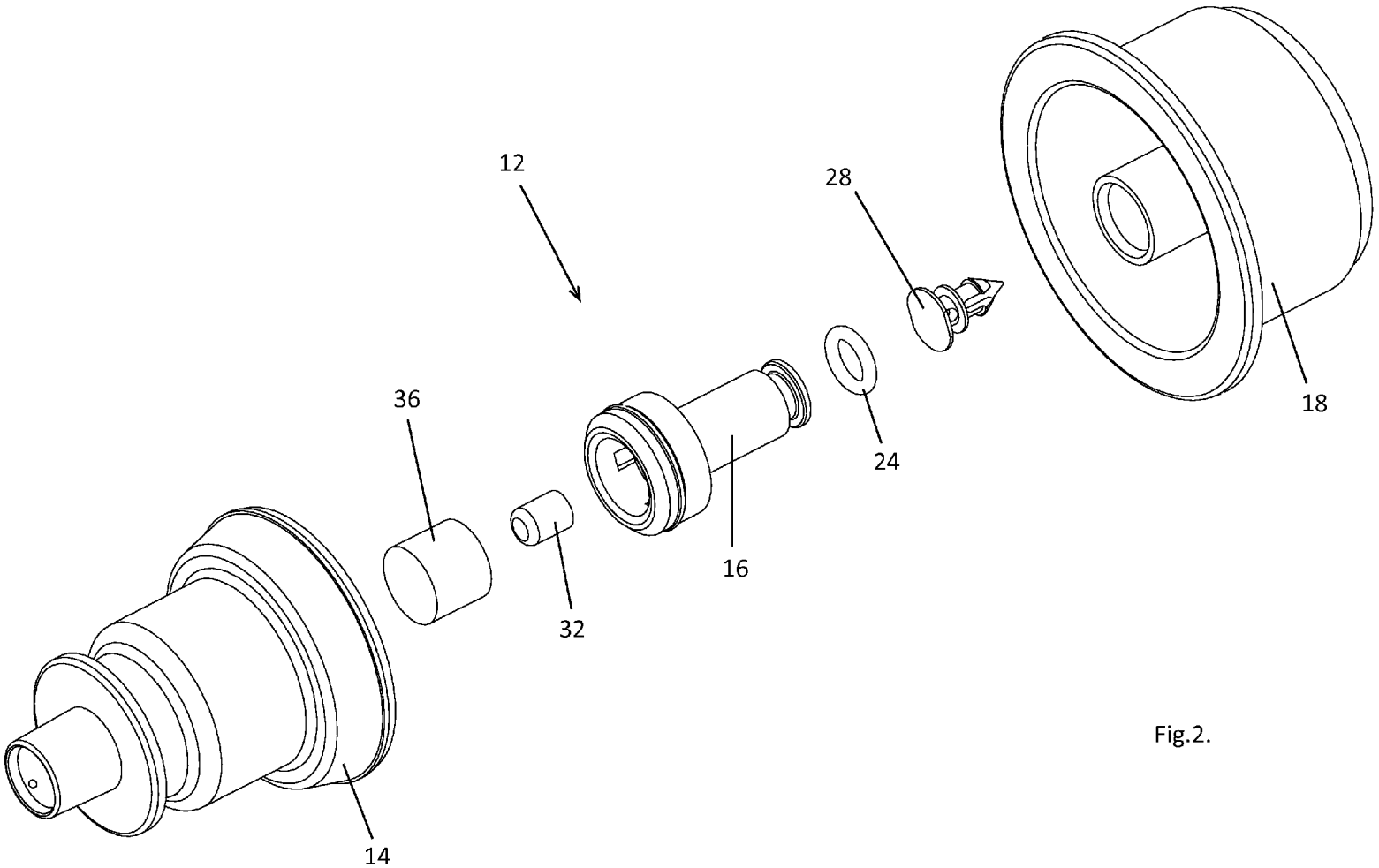
FIG. 2 is blown apart perspective view of the foaming assembly of the foam dispenser of FIG. 1.
Figure 3:
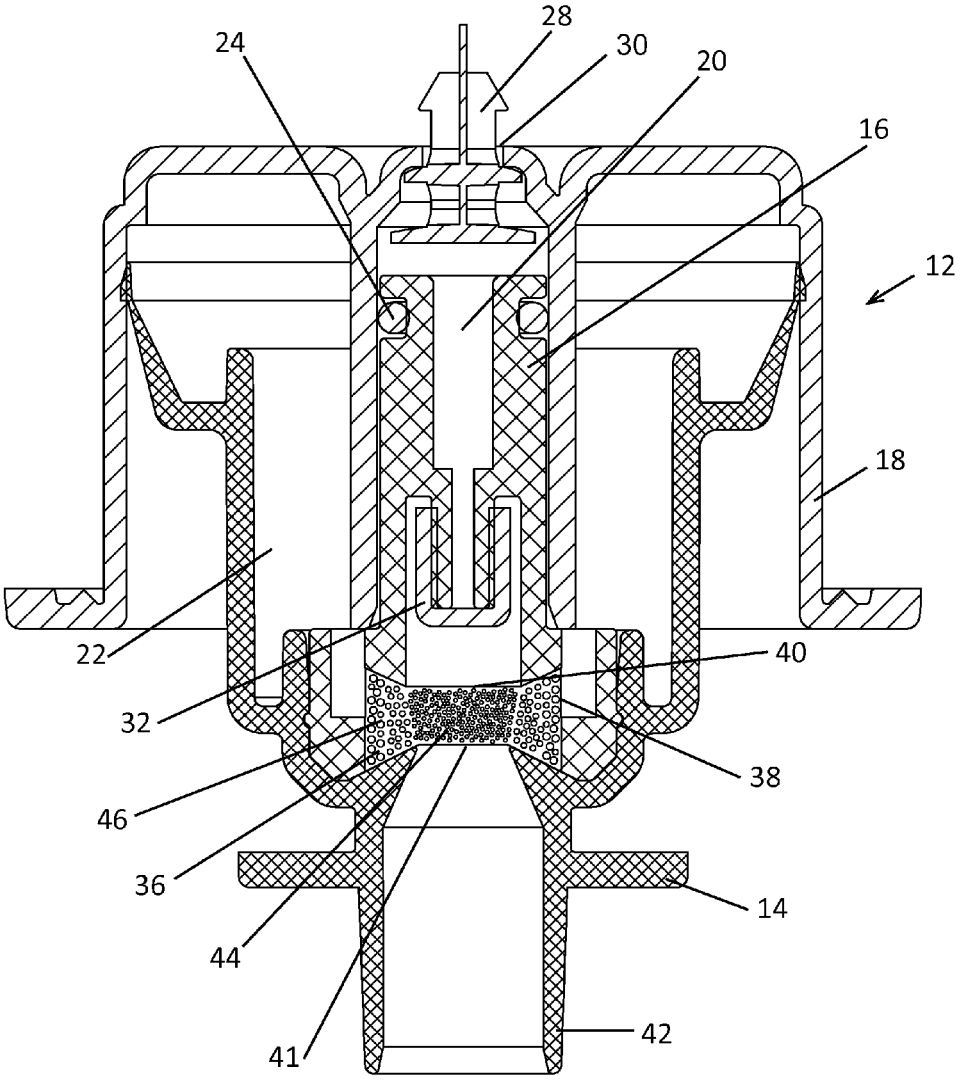
FIG. 3 is a sectional view of the foaming assembly of FIG. 2.

Referring to FIGS. 1 to 3, an unpressurized, non-aerosol foam dispenser is shown generally at 10. Dispenser 10 includes a foaming assembly 12 connected to a liquid container 13. The liquid container 13 is an unpressurized liquid container.

The foaming assembly 12 includes foam cone 14, a piston 16 and a bottle seal 18. The piston 16 and bottle seal 18 define a liquid chamber 20. The foam cone 14, bottle seal 18 and piston 16 define an air chamber 22. The liquid chamber 20 is a central liquid chamber and the air chamber 22 is an annular air chamber. The foam cone 16 moves relative to the bottle seal 18. The piston 16 is operably connected to the foam cone 14 with a press fit. An O-ring 24 slides between the piston 16 and the bottle seal 18 and provides a liquid seal therebetween.

The liquid container 13 is in flow communication with the liquid chamber 20. A bottle seal valve 28 controls the inlet 30 of the liquid chamber 20. A top hat valve 32 controls the outlet 34 of the liquid chamber 20.

A porous foaming element 36 is positioned between the piston 16 and the foam cone 14. The porous foaming element 36 has an air inlet 38, a liquid inlet 40 and an outlet 41. The air inlet 38 and liquid inlet 40 are spaced apart. The porous foaming element 36 has zones of different porosity. By way of example only the porous foaming element 36 has a smaller pore size zone 44 and a larger pore size zone 46. The porous foaming element 36 may be compressible material or it may be manufactured such that the pore size varies as prescribed. By way of example only the compressible material may be sponge material. Generally as pore size decreases the foam quality changes. It has been observed that as pore size decreases the resultant foam appears smoother or richer and thus would be considered better quality foam. As air and liquid are forced under pressure through the porous foaming element 36 the foam quality improves.

Figure 4:
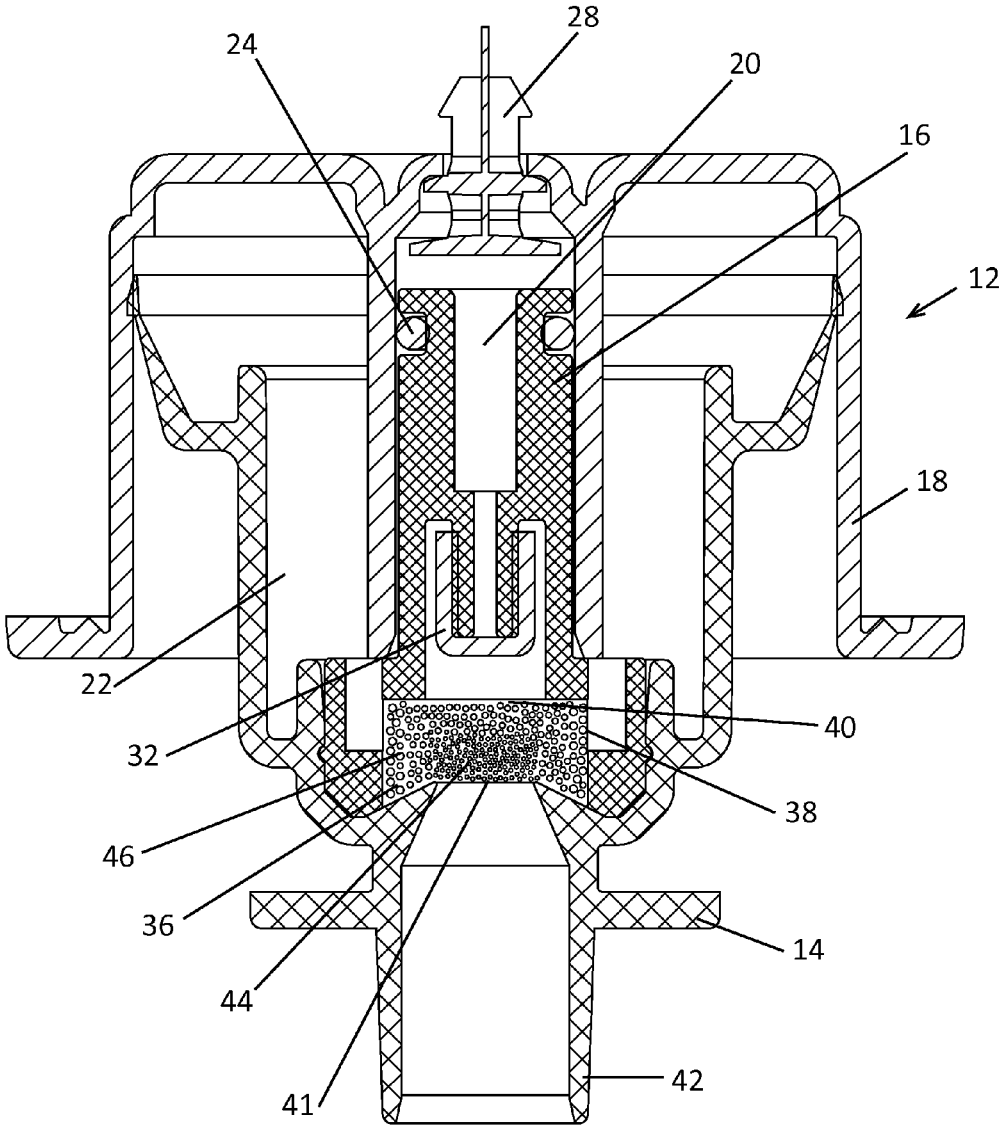
FIG. 4 is a sectional view of an alternate embodiment of the foaming assembly of FIG. 2.
Figure 5:
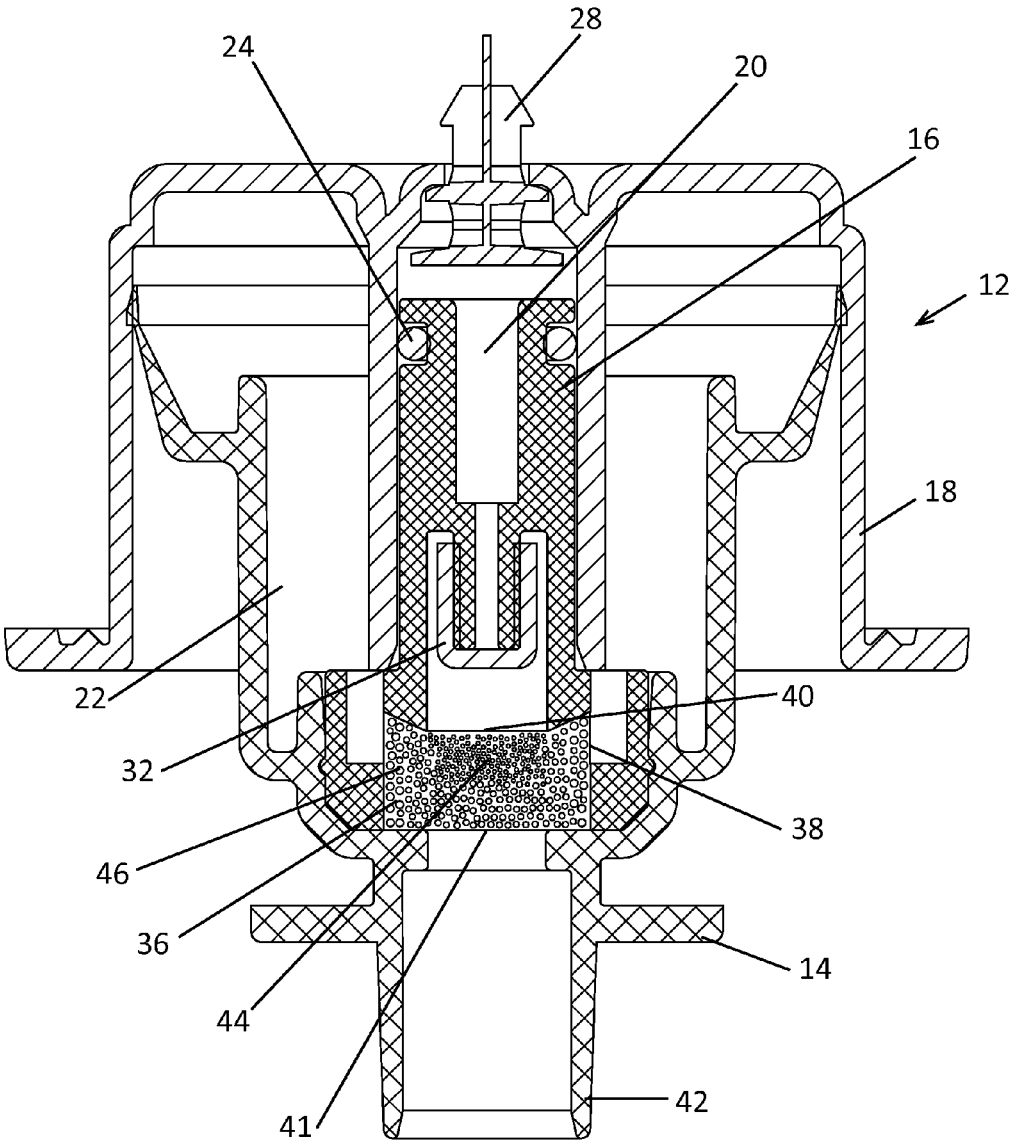
FIG. 5 is a sectional view of a further alternate embodiment of the foaming assembly of FIG. 2.

It will be appreciated by those skilled in the art that with a compressible porous foaming element the zones of different porosity are defined by the geometry of the piston 16 and the foam cone 14. Compression of the porous foaming element 36 is achieved during assembly. As shown in FIGS. 3 to 5, a variety of different configurations may be constructed such that the porous foaming element 36 has a compressed zone 44 having smaller pores and an expanded zone 46 with larger pores. The porous foaming element 36 may have a generally bow tie shape as shown in FIG. 3 wherein the larger pore size zone 46 is around the outside and the smaller pore size zone 44 is in the center, a half bow tie at the bottom as shown in FIG. 4 wherein the small pore size zone 44 is downstream of the larger pore size zone 46, or a half bow tie at the top as shown in FIG. 5, wherein the small pore size zone 44 is upstream of the larger pore size zone 46. Note that where the porous foaming element is made from compressible material there may be a gradual transition of pore size between the large pore size zone 46 to the small sore size zone 44.

In use when the dispenser 10 is activated the foam cone 14 moves inwardly relative to the bottle seal 18 thus moving between an at rest position to an activation position decreasing the internal volume of the liquid chamber 20 and the air chamber 22 thus pressurizing the liquid and air therein and forcing the liquid and air under pressure into porous foaming element 36. This embodiment is similar to that shown in U.S. Pat. No. 8,104,650 issued to Lang et al. on Jan. 31, 2012.

Figure 6:
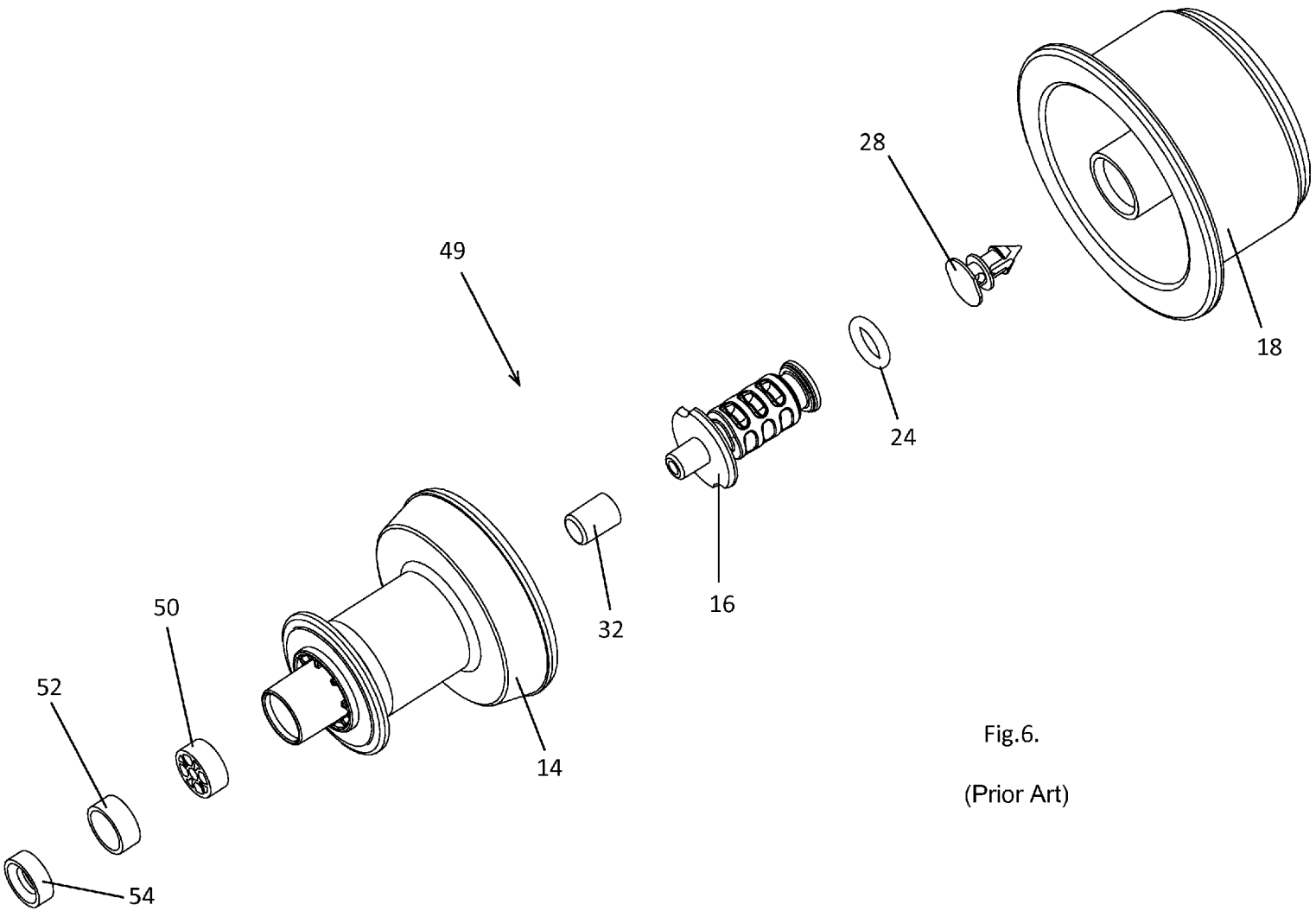
Fig.6. (Prior Art)
FIG. 6 is a blown apart perspective view of a prior art foaming assembly.
Figure 7:
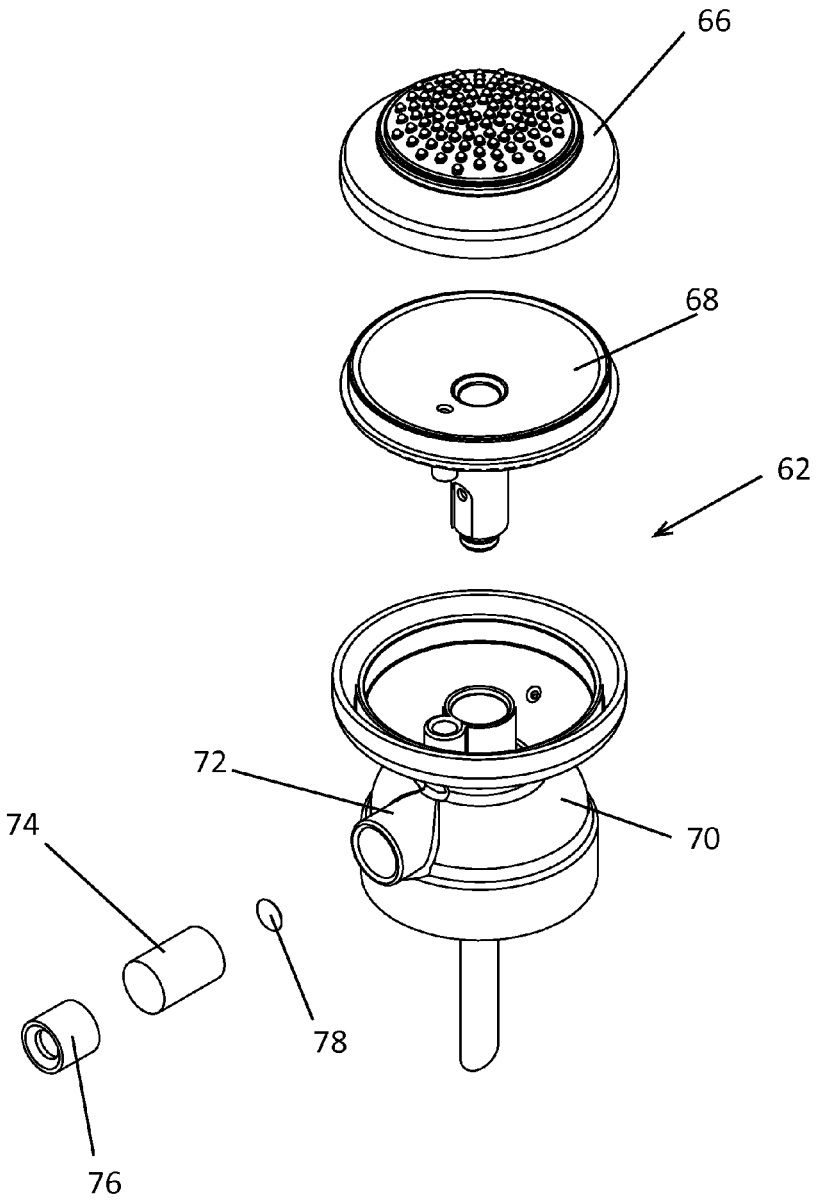
FIG. 7 is a blown apart perspective view of an alternate embodiment of a foaming assembly.

One advantage of the porous foaming element 36 is that it acts as both a foaming element and an anti-drip element. Thus in the embodiment described above a number of elements may be reduced. Comparing a prior art foaming component 49 shown in FIG. 6 to the embodiment described above, most of the components are the same except that it does not include the porous foaming element 36. Rather it includes the upstream gauze tube 50 having large gauze pores, downstream gauze tube 52 having smaller gauze pores and venturi ring 54, all of which are not needed in the embodiments of the present disclosure. The foam cone 14, valve 32, piston 16, O-ring 24, bottle seal valve 28 and bottle seal 18 are similar to those described above with regard to foaming assembly 12.

Figure 9:
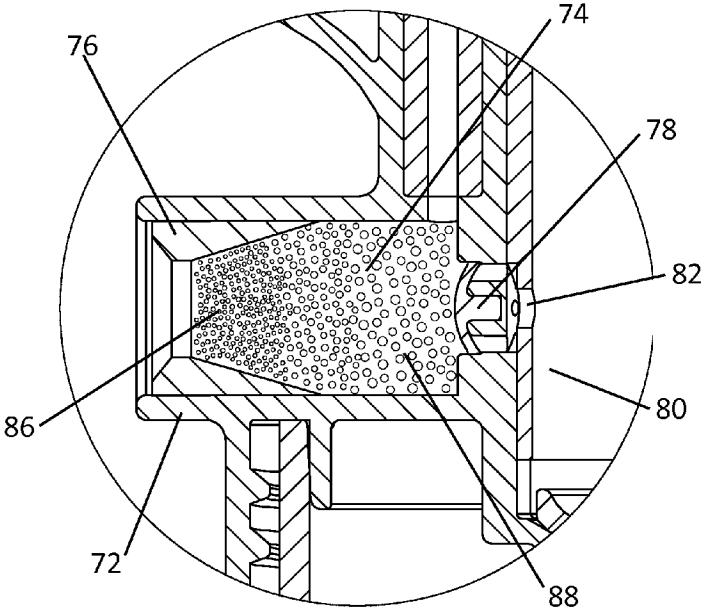
FIG. 9 is an enlarged sectional view of the nozzle portion of the foaming assembly shown in FIGS. 7 and 8.
Figure 8:
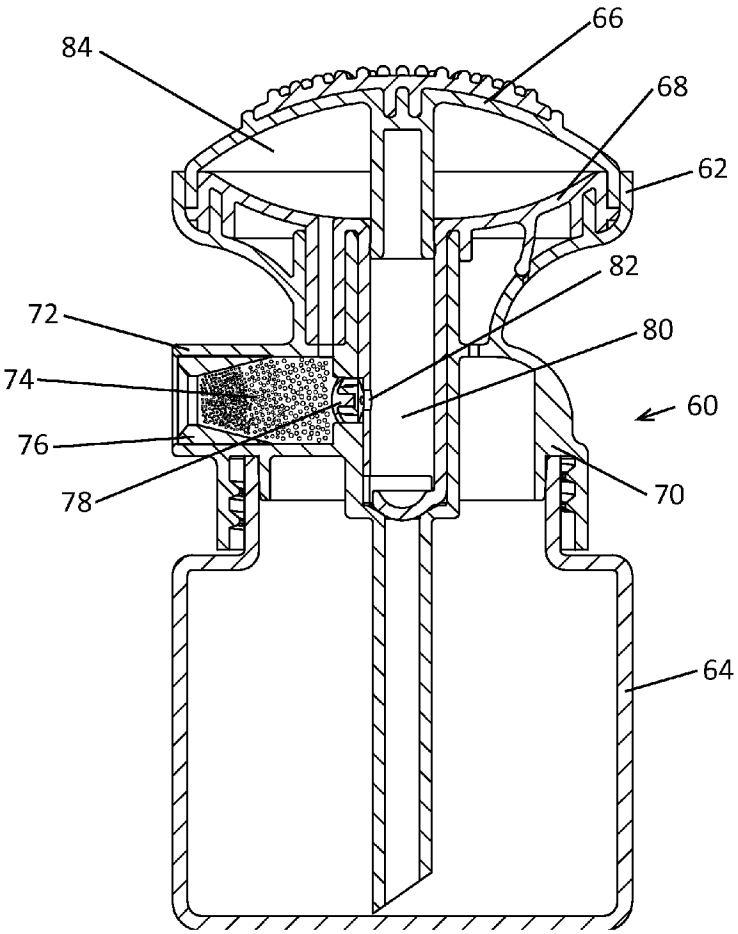
FIG. 8 is a sectional view of a foam dispenser including the foaming assembly of FIG. 7.
Figure 10:
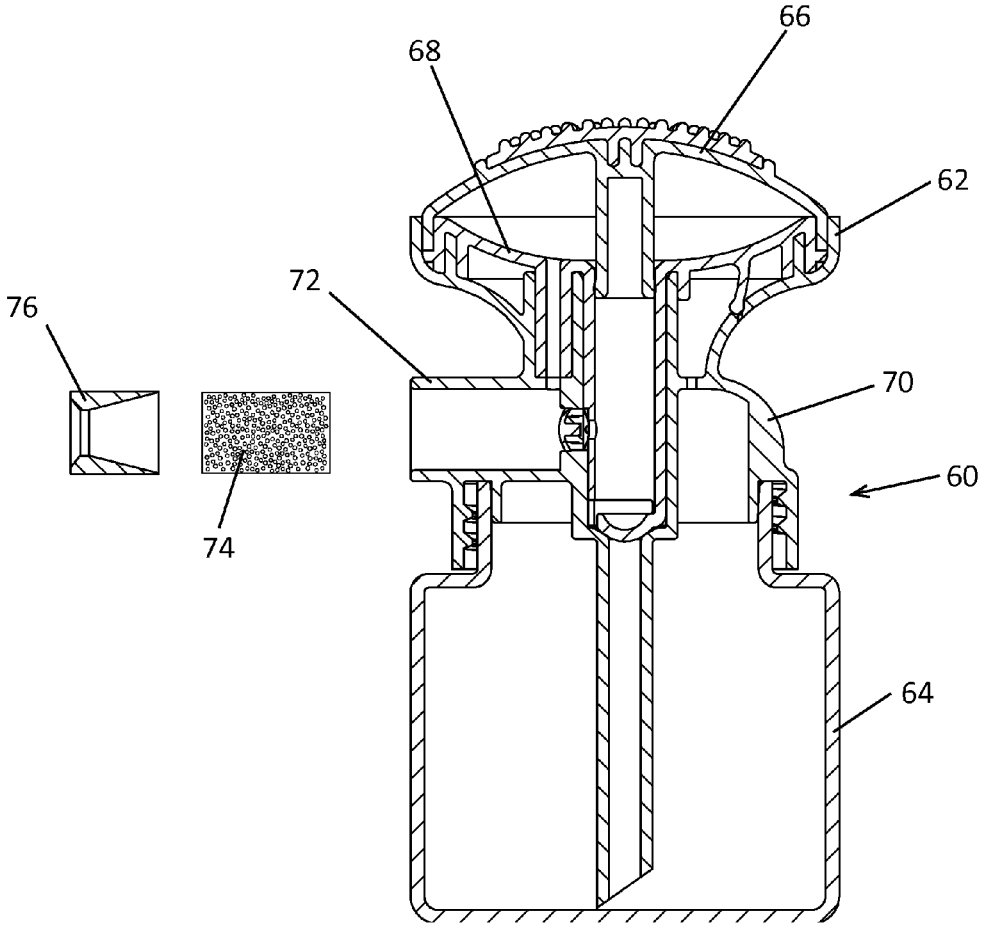
FIG. 10 is a sectional view of a partially assembled dispenser shown in FIG. 8 but showing the porous foaming element and venturi ring disassembled.

It will be appreciated by those skilled in the art that the porous foaming element described above may also be used in other type of pumps, for example dispenser 60 shown in FIG. 10 and described in detail in U.S. application Ser. No. 13/458,318 filed Apr. 27, 2012 to Banks et al. Referring to FIGS. 7 to 10, dispenser 60 includes a pump or foaming assembly 62 and a liquid container 64. Pump 62 includes a piston dome 66, a liquid and air bore 68 and a main pump body 70. The main pump body 70 includes an exit nozzle 72. A porous foaming element 74 is positioned in the exit nozzle 72. A venturi ring 76 is downstream of the porous foaming element 74. A valve 78 is positioned in exit nozzle 72 to selectively open and close the outlet 82 of liquid chamber 80. The liquid and air bore 68 and main body 70 define a liquid chamber 80. The piston dome 66 and liquid and air bore 68 define the air chamber 84. Movement inwardly of the piston dome 66 into the main body 70 decreases the volume of the liquid chamber 80 and the air chamber 84 thereby forcing under pressure air and liquid into the porous foaming element 74.

Figure 11:
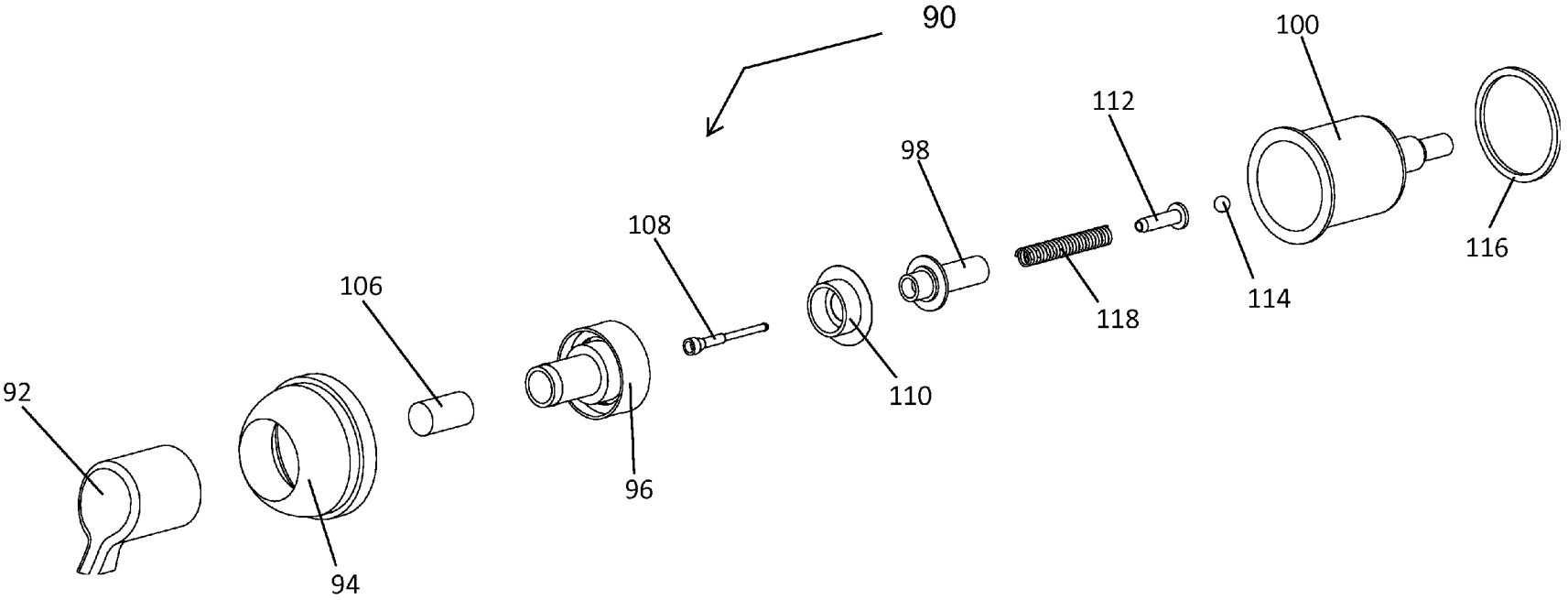
FIG. 11 is a blown apart perspective view of a further alternate embodiment of a foaming assembly.
Figure 12:
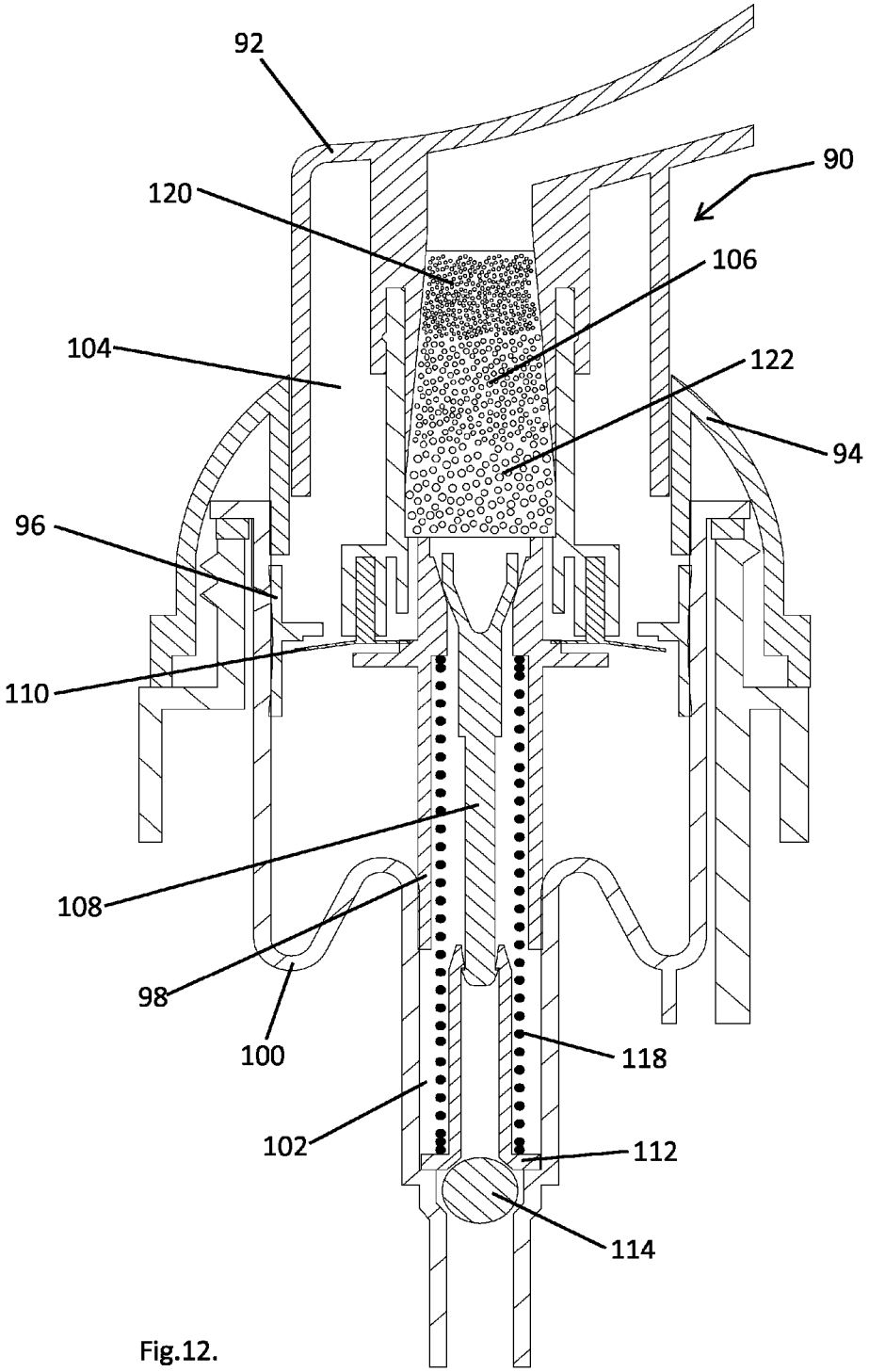
FIG. 12 is a sectional view of the foaming assembly of FIG. 11.

The porous foaming element 74 is positioned in the exit nozzle between the liquid chamber 80 and the venturi ring 76. The porous foaming element 74 is made of compressible material and a smaller pore size zone 86 is where the compressible material is more compressed than in a larger pore size zone 88. The porous foaming element 74 is defined by the geometry of the exit nozzle 72 and the venturi ring 76. In the assembly process the porous foaming element 74 is positioned in the nozzle 72 and then the venturi ring 76 is inserted into the nozzle 72. The geometry of the venturi ring 76 is configured to create a compressed area such that there is a smaller pore size zone 86 and a larger pore size zone 88 as best seen in FIG. 9. Referring to FIGS. 11 and 12, another example of a porous foaming assembly 90 is similar to that shown in U.S. Pat. No. 5,443,569 issued to Uehira et al. on Aug. 22, 1995 but modified to include a porous foaming element 106.

The porous foaming assembly 90 includes a pump head 92, a bottle cap 94, an air piston 96, a piston 98 and a main body 100. The main body 100 and piston 98 define the liquid chamber 102 and the pump head 92, bottle cap 94, air piston 96, piston 98 and main body 100 define the air chamber 104. Movement inwardly of the pump head 92 into the main body 100 decreases the volume of the liquid chamber 102 and the air chamber 104 thereby forcing, under pressure, air and liquid into a porous foaming element 106.

The porous foaming assembly 90 includes a valve stem 108 and air valve 110, a valve step 112, liquid valve 114 and main body seal 116. A spring 118 biases pump head 92 into an at rest position. Moving the pump head 92 into the main body 100 and into an activation position decreases the volume of the air chamber 104 and liquid chamber 102. The shape of the porous foaming element 106 is defined by the geometry of the air piston 96 and the pump head 92 defining a smaller pore size zone 120 and a larger pore size zone 122.

Figure 14:
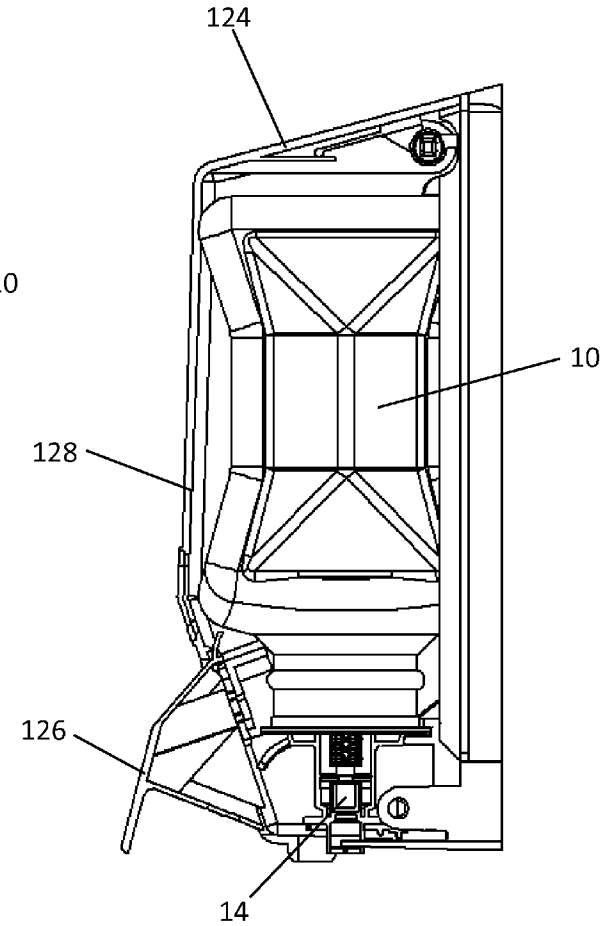
FIG. 14 is a side view of FIG. 13.
Figure 13:
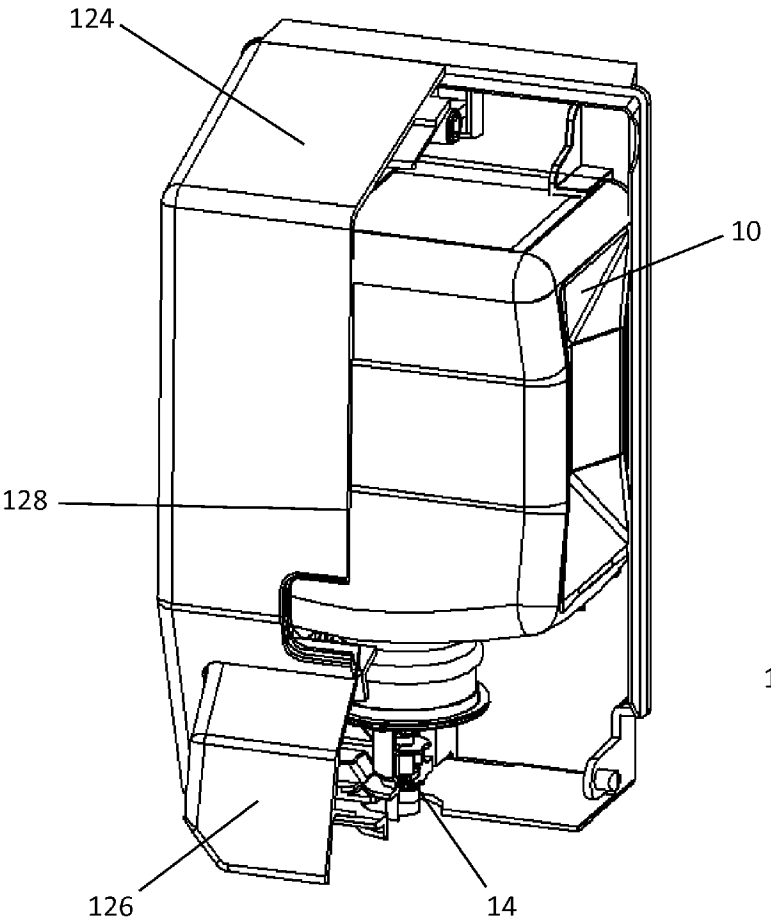
FIG. 13 is a perspective view of the soap dispenser of FIG. 1 and showing an outer housing broken away.

The dispensers described above may further include a housing. Referring to FIGS. 13 and 14, dispenser 10 may further include a housing 124. The housing 124 has an actuator 126 that engages foam cone 14 such that moving the actuator 126 moves the foam cone 14. Housing 124 may include a sensor 128 that activates the sensor response to the sensor sensing the presence of a user.

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately" are meant to cover variations that may exist in the upper and lower limits of the ranges of values, such as variations in properties, parameters, and dimensions. In one non-limiting example, the terms "about" and "approximately" mean plus or minus 10 percent or less.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

What is claimed is:

1. A foaming assembly comprising;

a porous foaming element filled with porous material and having an air inlet, a liquid inlet spaced and separated from the air inlet, and an outlet at a downstream end, the porous foaming element having an upstream end spaced apart from the downstream end, wherein the porous material fills the porous foaming element from the upstream end to the downstream end, and has at least two zones of different pore sizes between the upstream and downstream ends of the porous foaming element;

a liquid chamber in flow communication with the porous foaming element, the liquid chamber having a volume that is movable between an at rest position to an activation position;

an air chamber in flow communication with the porous foaming element, the air chamber having a volume that is movable between an at rest position to an activation position; and whereby liquid and air are forced into the porous foaming element under pressure and air from the air inlet and liquid from the liquid inlet mix in the porous foaming element to form foam which exits through the outlet.

2. The foaming assembly of claim 1 wherein the porous foaming element has a smaller pore size zone and a larger pore size zone.

3. The foaming assembly of claim 2 wherein the smaller pore size zone is downstream of the larger pore size zone.

4. The foaming assembly of claim 2 wherein the smaller pore size zone is upstream of the larger pore size zone.

5. The foaming assembly of claim 1 wherein the porous foaming element is generally bow tie shape in cross section.

6. The foaming assembly of claim 1 wherein the foaming assembly further includes a foam cone, a piston and a bottle seal and wherein the piston and bottle seal define the liquid chamber, the foam cone, bottle seal and piston define the air chamber and movement inwardly of the foam cone into the bottle seal decreases the volume of the liquid chamber and the air chamber thereby forcing under pressure air and liquid into the porous foaming element.

7. The foaming assembly of claim 6 wherein the porous foaming element is positioned in the foam cone between the foam cone and the piston.

8. The foaming assembly of claim 7 wherein the porous foaming element is made of compressible material and a smaller pore size zone is where the compressible material is more compressed than in a larger pore size zone.

9. The foaming assembly of claim 8 wherein the shape of the porous foaming element is defined by the geometry of the piston and the foam cone.

10. A foam dispenser comprising:

a liquid container;

a porous foaming element filled with porous material and having an air inlet, a liquid inlet spaced and separated from the air inlet, and an outlet at a downstream end, the porous foaming element having an upstream end spaced apart from the downstream end, wherein the porous material fills the porous foaming element from the upstream end to the downstream end, and has at least two zones of different pore sizes between the upstream and downstream ends of the porous foaming element;

a liquid chamber in flow communication with the porous foaming element, the liquid chamber having a volume that is movable between an at rest position to an activation position, an air chamber in flow communication with the porous foaming element, the air chamber having a volume that is movable between an at rest position to an activation position; and whereby liquid and air are forced into the porous foaming element under pressure and air from the air inlet and liquid from the liquid inlet mix in the porous foaming element to form foam which exits through the outlet.

11. A method of making foam including the steps of forcing air under pressure through an air inlet into a porous foaming element filled with porous material and forcing liquid under pressure through a liquid inlet spaced and separated from the air inlet into the porous foaming element filled with porous material, the porous foaming element having an upstream end spaced apart from a downstream end, wherein the porous material fills the porous foaming element from the upstream end to the downstream end, and has at least two zones of different pore sizes between the upstream and downstream ends of the porous foaming element, wherein the air and the liquid mix in the porous foaming element to form foam which exits through an outlet at the downstream end.

* * * * *